US011139101B2

(12) United States Patent
Otsubo et al.

(10) Patent No.: US 11,139,101 B2
(45) Date of Patent: Oct. 5, 2021

(54) COIL COMPONENT

(71) Applicant: Murata Manufacturing Co., Ltd., Kyoto (JP)

(72) Inventors: Yoshihito Otsubo, Kyoto (JP); Norio Sakai, Kyoto (JP)

(73) Assignee: MURATA MANUFACTURING CO., LTD., Kyoto (JP)

( * ) Notice: Subject to any disclaimer, the term of this patent is extended or adjusted under 35 U.S.C. 154(b) by 1205 days.

(21) Appl. No.: 15/491,120

(22) Filed: Apr. 19, 2017

(65) Prior Publication Data

US 2017/0221624 A1 Aug. 3, 2017

Related U.S. Application Data

(63) Continuation of application No. PCT/JP2015/078997, filed on Oct. 14, 2015.

(30) Foreign Application Priority Data

Oct. 22, 2014 (JP) ..... 2014-214970

(51) Int. Cl.
*H01F 27/28* (2006.01)
*H01F 27/29* (2006.01)
(Continued)

(52) U.S. Cl.
CPC ..... *H01F 27/2804* (2013.01); *H01F 17/0013* (2013.01); *H01F 17/0033* (2013.01);
(Continued)

(58) Field of Classification Search
CPC ..... H01F 27/2804; H01F 27/29
See application file for complete search history.

(56) References Cited

U.S. PATENT DOCUMENTS 6,181,130 B1 * 1/2001 Hoshi ..... G01R 33/045 324/253
7,375,611 B1 * 5/2008 Pleskach ..... H01F 27/2804 336/229

(Continued)

FOREIGN PATENT DOCUMENTS

CN 103943306 A 7/2014
JP 2000277336 A 10/2000

(Continued)

OTHER PUBLICATIONS

International Search Report for PCT/JP2015/078997 dated Dec. 15, 2015.

(Continued)

*Primary Examiner* — Elvin G Enad
*Assistant Examiner* — Malcolm Barnes
(74) *Attorney, Agent, or Firm* — Pearne & Gordon LLP

(57) ABSTRACT

A coil component includes an insulating layer in which a magnetic core is embedded, coil electrodes wound around the magnetic core, external connection pad electrodes that are provided on the upper surface of the insulating layer and are connected to the coil electrodes. Each of the coil electrodes includes a plurality of inner metal pins standing in the insulating layer, a plurality of outer metal pins standing in the insulating layer, a plurality of upper wiring patterns formed on the upper surface of the insulating layer, and a plurality of lower wiring pattern formed on the undersurface of the insulating layer. Each of the pad electrodes is directly connected to the upper end surface of the inner metal pin or the outer metal pin, and has, in plan view, an area larger than that of the single upper wiring pattern or the single lower wiring pattern.

14 Claims, 6 Drawing Sheets

(51) Int. Cl.
*H01F 17/00* (2006.01)
*H01F 17/06* (2006.01)

(52) U.S. Cl.
CPC ..... *H01F 17/062* (2013.01); *H01F 27/29* (2013.01); *H01F 27/292* (2013.01)

(56) References Cited

U.S. PATENT DOCUMENTS

2003/0025585 A1* 2/2003 Macerini ..... H01F 27/2804 336/65
2003/0048168 A1* 3/2003 Schutten ..... H01F 27/2804 336/229
2004/0135662 A1* 7/2004 Harding ..... H01F 17/0006 336/229
2006/0049905 A1* 3/2006 Maeda ..... H01F 17/0013 336/200
2008/0186124 A1* 8/2008 Schaffer ..... H01F 27/2895 336/200
2009/0002111 A1* 1/2009 Harrison ..... H01F 19/04 336/69
2009/0160596 A1* 6/2009 Yang ..... H01F 27/2804 336/84 C
2009/0167477 A1* 7/2009 Feng ..... H01F 17/062 336/200
2013/0200977 A1* 8/2013 Miyazaki ..... H01F 17/0013 336/192
2015/0035638 A1* 2/2015 Stephanou ..... H01F 17/0033 336/200
2015/0061817 A1* 3/2015 Lee ..... H01F 17/0033 336/221
2016/0276086 A1* 9/2016 Quilici ..... H01F 41/042
2019/0333674 A1* 10/2019 Quilici ..... H05K 1/165

FOREIGN PATENT DOCUMENTS

JP 2010516056 A 5/2010
JP 2013207149 A 10/2013

OTHER PUBLICATIONS

Written Opinion for PCT/JP2015/078997 dated Dec. 15, 2015.
Chinese Office Action for Chinese Application No. 201580057056.3, dated Apr. 17, 2018.

* cited by examiner

COIL COMPONENT

This application is a continuation of International Application No. PCT/JP2015/078997 filed on Oct. 14, 2015 which claims priority from Japanese Patent Application No. 2014-214970 filed on Oct. 22, 2014. The contents of these applications are incorporated herein by reference in their entireties.

BACKGROUND OF THE DISCLOSURE

Field of the Disclosure

The present disclosure relates to a coil component that includes an insulating layer in which a coil core is embedded and a coil electrode wound around the coil core and is connected to the outside.

Description of the Related Art

In electronic apparatuses using high-frequency signals, a coil component including a toroidal coil mounted on a wiring board is sometimes used as a noise canceling component. Since this toroidal coil is relatively large as compared with other components mounted on a wiring board, the toroidal coil takes up a large mount region on the wiring board. In addition, the mounting of a large toroidal coil on a wiring board makes it difficult to reduce the profile of a coil component.

A technique for downsizing a coil component by embedding a toroidal coil in a wiring board has been proposed. For example, as illustrated in FIG. 8, a coil component 100 disclosed in Patent Document 1 includes a wiring board 101 including the laminate of a plurality of insulating layers, a toroidal magnetic core 102 embedded in the wiring board 101, and a coil electrode 103 helically wound around the magnetic core 102 in the wiring board 101.

The coil electrode 103 includes a plurality of upper wiring electrode patterns 103*a* formed on an insulating layer on the upper side of the magnetic core 102, a plurality of lower wiring electrode patterns 103*b* formed on an insulating layer on the lower side of the magnetic core 102, and a plurality of interlayer connection conductors 104 each of which connects a predetermined one of the upper wiring electrode patterns 103*a* and a predetermined one of the lower wiring electrode patterns 103*b*. An end portion of the coil electrode 103 is connected to a lead line 105 and is connectable to the outside via, for example, a pad electrode provided at the destination of the lead line 105. The upper wiring electrode patterns 103*a*, the lower wiring electrode patterns 103*b*, and the lead line 105 are each formed by etching a Cu foil. The interlayer connection conductors 104 are each formed by applying plating to a via hole formed in an insulating layer. Thus, by embedding the magnetic core 102 and the coil electrode 103 in the wiring board 101, it is possible to reduce the area of the main surface of the wiring board 101 while ensuring a mount area for mount components on the wiring board 101 and reduce the profile of the coil component 100.

Patent Document 1: Japanese Unexamined Patent Application Publication No. 2013-207149 (paragraphs 0015 to 0021, see, for example, FIG. 1)

BRIEF SUMMARY OF THE DISCLOSURE

With the downsizing of electronic apparatuses in current years, the further downsizing of coil components is needed. In order to satisfy this need, a method of making the upper wiring electrode patterns 103*a* and the lower wiring electrode patterns 103*b* thin and downsizing the pad electrode used for external connection can be considered. However, the downsizing of the pad electrode reduces the strength of connection to the outside. The lead line 105 for connecting the pad electrode and the coil electrode 103 inhibits the downsizing of the coil component 100.

It is an object of the present disclosure to provide a small-sized coil component having a high reliability of connection to the outside.

The present disclosure provides a coil component including an insulating layer in which a coil core is embedded, a coil electrode wound around the coil core, and an external connection pad electrode that is provided on one main surface of the insulating layer and is connected to the coil electrode. The coil electrode includes a plurality of one-side columnar conductors arranged on one side of the coil core in a state of standing in a thickness direction of the insulating layer, a plurality of other-side columnar conductors that are arranged on the other side of the coil core in a state of standing in the thickness direction of the insulating layer to be paired with the corresponding one-side columnar conductors, a plurality of first wiring patterns that are formed on the one main surface of the insulating layer and are each configured to connect one end surfaces of the one-side columnar conductor and the other-side columnar conductor paired with each other, and a plurality of second wiring patterns that are formed on the other main surface of the insulating layer and are each configured to connect the other end surface of the one-side columnar conductor and the other end surface of the other-side columnar conductor adjacent to the other-side columnar conductor paired with the one-side columnar conductor on a predetermined side. The pad electrode is directly connected to the one end surface of predetermined one of the one-side columnar conductors or the one end surface of predetermined one of the other-side columnar conductors and has, in plan view, an area larger than that of the single wiring pattern.

In this case, the area of a pad electrode used for external connection is larger than that of a single wiring pattern in plan view. It is therefore possible not only to make the wiring patterns thin for the purpose of miniaturization but also to improve the reliability of connection of a coil component to the outside. Since the pad electrode is directly connected to the end surface of a predetermined one-side columnar conductor or a predetermined other-side columnar conductor without a lead line for connecting the coil electrode and the pad electrode, the miniaturization of the coil component can be achieved.

The pad electrode may partially overlap the coil core in plan view. With this configuration, the pad electrode can also function as a part of the coil electrode. Accordingly, not only the miniaturization of the coil component and the improvement in reliability of connection of the coil component to the outside but also the improvement in coil characteristics (for example, the improvement in inductance value) can be achieved.

An insulating film may overlap a part of the pad electrode on the one main surface of the insulating layer. A remaining part of the pad electrode excluding the part of the pad electrode may function as an external connection surface. In this case, the area of the external connection surface can be adjusted with the insulating film.

The connection surface may overlap the coil core in plan view. With this configuration, the heat dispersion characteristics of the coil electrode can be improved in a case where the coil component is connected to the outside by soldering.

The one main surface of the insulating layer may be rectangular in shape when viewed in a plan view. The pad electrode may be provided in one corner portion of the one main surface of the insulating layer. By disposing pad electrodes in the respective four corner portions of the insulating layer having a sufficient design space, the areas of the pad electrodes can be easily increased.

Each of the one-side columnar conductors and the other-side columnar conductors may be formed of a metal pin. In the case of via conductors and through hole conductors for which the formation of a through hole is needed, a predetermined gap is needed between adjacent conductors for the formation of independent through holes. There is therefore limit to the narrowing of the gap between the adjacent conductors for the purpose of the increase in the number of windings of a coil. However, in the case of the metal pins for which the formation of a through hole is not needed, the gap between adjacent metal pins can be easily narrowed. It is therefore possible to increase the number of windings of the coil electrode to improve the coil characteristics of the coil electrode (to increase the inductance of the coil electrode).

Since the specific resistance of the metal pins is lower than that of a via conductor or a through hole conductor formed by filling conductive paste into a via hole, the overall resistance value of the coil electrode can be reduced. A coil component having an excellent coil characteristics represented by, for example, a Q value can therefore be provided.

According to the present disclosure, the area of a pad electrode used for external connection is larger than that of a single wiring pattern in plan view. It is therefore possible not only to make the wiring pattern thin for the purpose of miniaturization but also to improve the reliability of connection of a coil component to the outside. Since the pad electrode is directly connected to the one end surface of one-side columnar conductor or the other-side columnar conductor included in a coil electrode without a lead line for connecting the coil electrode and the pad electrode, the miniaturization of the coil component can be achieved.

DETAILED DESCRIPTION OF THE DISCLOSURE

First Embodiment

Figure 1A:
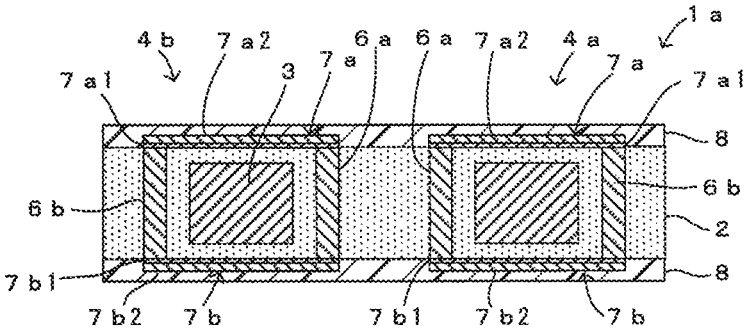
FIGS. 1A, 1B and 1C are diagrams illustrating a coil component according to a first embodiment of the present disclosure.
Figure 1B:
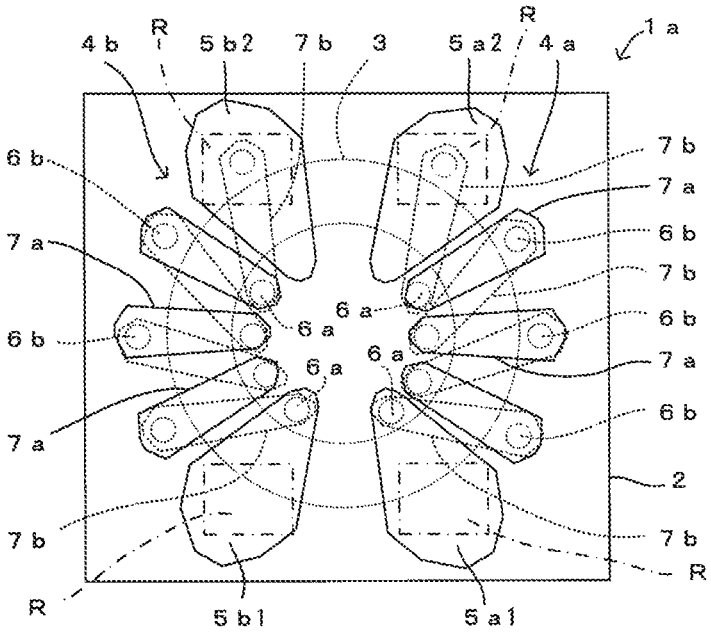
Figure 1C:
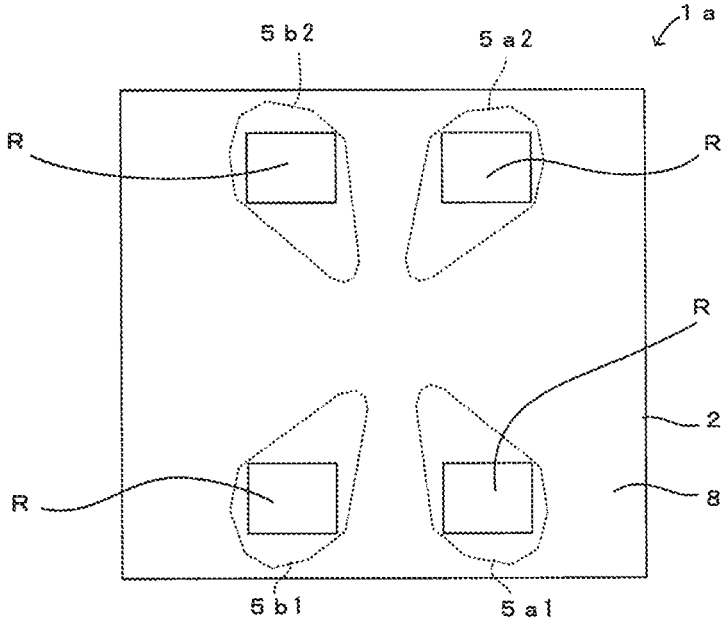

A coil component 1*a* according to the first embodiment of the present disclosure will be described with reference to FIGS. 1A, 1B and 1C. FIG. 1A is a cross-sectional view of the coil component 1*a*. FIG. 1B is a plan view of the coil component 1*a* in which an insulating film 8 is not illustrated. FIG. 1C is a plan view of the coil component 1*a* in which the insulating film 8 is illustrated.

As illustrated in FIGS. 1A to 1C, the coil component 1*a* according to this embodiment includes an insulating layer 2 in which a magnetic core 3 (corresponding to a "coil core" according to the present disclosure) is embedded, two coil electrodes 4*a* and 4*b* wound around the magnetic core 3, and pad electrodes 5*a*1, 5*a*2, 5*b*1, and 5*b*2 for external connection which are provided on the upper surface (corresponding to a "one main surface" according to the present disclosure) of the insulating layer 2 and are connected to the coil electrodes 4*a* and 4*b*. The coil component 1*a* is mounted on, for example, an external motherboard by, for example, soldering as a pulse transfer coil.

The insulating layer 2 is made of, for example, a resin such as an epoxy resin, and has a predetermined thickness to cover the magnetic core 3 and metal pins 6*a* and 6*b* to be described later.

The magnetic core 3 is made of a magnetic material such as Mn—Zn ferrite employed for a common coil core. In this embodiment, the magnetic core 3 has a toroidal shape.

The coil electrodes 4*a* and 4*b* are helically wound around the magnetic core 3. Each of the coil electrodes 4*a* and 4*b* includes the metal pins 6*a* and 6*b* that are provided around the magnetic core 3 in a state of standing in the thickness direction of the insulating layer 2, a plurality of upper wiring patterns 7*a*, and a plurality of lower wiring patterns 7*b*. The metal pins 6*a* and 6*b* are made of a metal material such as Cu, Au, Ag, Al, or a Cu alloy that is commonly employed for a wiring electrode. The metal pins 6*a* and 6*b* can be formed by shearing a metal wire rod made of any one of these metal materials.

The metal pins 6*a* are arranged along the inner peripheral surface of the magnetic core 3 (hereinafter also referred to as the inner metal pins 6*a*), and the metal pins 6*b* are arranged along the outer peripheral surface of the magnetic core 3 so that they are paired with the corresponding metal pins 6*a* (hereinafter also referred to as the outer metal pins 6*b*). In this embodiment, the upper end surfaces (corresponding to "one end surfaces" according to the present disclosure) of the metal pins 6*a* and the metal pins 6*b* are exposed at the top surface of the insulating layer 2, and the lower end surfaces (corresponding to "the other end surfaces" according to the present disclosure) of the metal pins 6*a* and the metal pins 6*b* are exposed at the undersurface of the insulating layer 2. The inner metal pin 6*a* corresponds to a "one-side columnar conductor" according to the present disclosure, and the outer metal pin 6*b* corresponds to an "other-side columnar conductor" according to the present disclosure.

In the coil electrode 4*a*, the upper end surfaces of the inner metal pin 6*a* and the outer metal pin 6*b*, which are arranged in pairs, are connected to the upper wiring pattern 7*a* (corresponding to a "first wiring pattern" according to the present disclosure) formed on the upper surface of the insulating layer 2. The lower end surfaces of the inner metal pin 6*a* and the outer metal pin 6*b* adjacent to the outer metal pin 6*b* paired with the inner metal pin 6*a* on a predetermined side (a clockwise direction in FIG. 1B) are connected to the lower wiring pattern 7*b* formed on the undersurface of the insulating layer 2.

In the coil electrode 4*b*, the upper end surfaces of the inner metal pin 6*a* and the outer metal pin 6*b*, which are arranged in pairs, are connected to the upper wiring pattern 7*a* formed on the upper surface of the insulating layer 2. The lower end surfaces of the inner metal pin 6*a* and the outer metal pin 6*b* adjacent to the outer metal pin 6*b* paired with the inner metal pin 6*a* on a predetermined side (a counterclockwise direction in FIG. 1B) are connected to the lower wiring pattern 7*b* formed on the undersurface of the insulating layer 2.

The two coil electrodes 4*a* and 4*b* that are helically wound around the magnetic core 3 have the above-described structure of connection among the inner metal pins 6*a*, the outer metal pins 6*b*, the upper wiring patterns 7*a*, and the lower wiring patterns 7*b*. Each of the upper wiring patterns 7*a* includes a base electrode 7*a*1 formed by, for example, applying a coating of conductive paste containing a metal such as Cu or Ag to the upper surface of the insulating layer 2 and a surface electrode 7*a*2 formed by, for example, applying a coating of Cu plating to the base electrode 7*a*1. Each of the lower wiring patterns 7*b* includes a base electrode 7*b*1 formed by, for example, applying a coating of conductive paste containing a metal such as Cu or Ag to the undersurface of the insulating layer 2 and a surface electrode 7*b*2 formed by, for example, applying a coating of Cu plating to the base electrode 7*b*1.

One end of the coil electrode 4*a* is connected to the pad electrode 5*a*1, and the other end of the coil electrode 4*a* is connected to the pad electrode 5*a*2. One end of the coil electrode 4*b* is connected to the pad electrode 5*b*1 and the other end of the coil electrode 4*b* is connected to the pad electrode 5*b*2. The pad electrodes 5*a*1, 5*a*2, 5*b*1, and 5*b*2 are used as input/output electrodes. In this embodiment, the pad electrodes 5*a*1 and 5*a*2 are directly connected to the coil electrode 4*a* without the intervention of a lead line, and the pad electrodes 5*b*1 and 5*b*2 are directly connected to the coil electrode 4*b* without the intervention of a lead line. Specifically, the inner metal pin 6*a* (corresponding to "a predetermined one of the one-side columnar conductors" according to the present disclosure) is disposed at one end of the coil electrode 4*a*, the outer metal pin 6*b* (corresponding to "a predetermined one of the other-side columnar conductors" according to the present disclosure) is disposed at the other end of the coil electrode 4*a*, and the pad electrodes 5*a*1 and 5*a*2 are connected to the end surfaces of the metal pins 6*a* and 6*b*, respectively. The inner metal pin 6*a* (corresponding to "a predetermined one-side columnar conductor" according to the present disclosure) is disposed at one end of the coil electrode 4*b*, the outer metal pin 6*b* (corresponding to "a predetermined other-side columnar conductor" according to the present disclosure) is disposed at the other end of the coil electrode 4*b*, and the pad electrodes 5*b*1 and 5*b*2 are connected to the end surfaces of the metal pins 6*a* and 6*b*, respectively. For example, the outer metal pin 6*b* is disposed at one end of the coil electrode 4*a*, the inner metal pin 6*a* is disposed at the other end of the coil electrode 4*a*, and the pad electrodes 5*a*1 and 5*a*2 are connected to the upper end surfaces of the metal pins 6*a* and 6*b*, respectively.

Each of the pad electrodes 5*a*1, 5*a*2, 5*b*1, and 5*b*2 has, in plan view, an area larger than that of the upper wiring pattern 7*a* or the lower wiring pattern 7*b*, and is disposed to be partially overlapped with the magnetic core 3 in plan view. Specifically, like the upper wiring patterns 7*a* and the lower wiring patterns 7*b*, the pad electrodes 5*a*1, 5*a*2, 5*b*1, and 5*b*2 extend across the magnetic core 3 from the outer peripheral side to the inner peripheral side. The pad electrodes 5*a*1, 5*a*2, 5*b*1, and 5*b*2 can therefore have not only a function of being an electrode for external connection but also a function of being a part of a coil.

In this embodiment, as illustrated in FIG. 1B, the four pad electrodes 5*a*1, 5*a*2, 5*b*1, and 5*b*2 are placed at the four corners of the rectangular upper surface of the insulating layer 2 in plan view (at positions near the four corners of an edge of the upper surface) one by one. The pad electrodes 5*a*1, 5*a*2, 5*b*1, and 5*b*2 and the upper wiring patterns 7*a* are formed at the same time. That is, each of the pad electrodes 5*a*1, 5*a*2, 5*b*1, and 5*b*2 includes a base electrode formed by screen printing using a conductive paste containing a metal such as Cu or Ag and a surface electrode formed by applying the coating of Cu plating to the base electrode.

On the upper surface of the insulating layer 2, the insulating film 8 is formed to cover the upper wiring patterns 7*a* and the parts of the pad electrodes 5. As illustrated in FIG. 1C, the insulating film 8 covers a region other than rectangular regions R (hereinafter also referred to as connection surfaces R) of the pad electrodes 5*a*1, 5*a*2, 5*b*1, and 5*b*2 in plan view which are set as surfaces for external connection. The shape and area of the connection surface R set for each of the pad electrodes 5*a*1, 5*a*2, 5*b*1, and 5*b*2 can be changed as appropriated. The insulating film 8 is formed of, for example, an insulating material such as a resist resin.

The connection surfaces R of the pad electrodes 5*a*1, 5*a*2, 5*b*1, and 5*b*2 may be overlapped with the magnetic core 3 in plan view. In a case where the coil component 1*a* is connected to the outside by soldering, the heat dispersion characteristics of the coil electrodes 4*a* and 4*b* can therefore be improved.

According to the above-described embodiment, since the area of each of the pad electrodes 5*a*1, 5*a*2, 5*b*1, and 5*b*2 in plan view is larger than that of the upper wiring pattern 7*a* or the lower wiring pattern 7*b*, it is possible not only to make each of the upper wiring patterns 7*a* and the lower wiring patterns 7*b* thin for the purpose of miniaturization but also to improve the reliability of connection of the coil component 1*a* to the outside. Furthermore, since each of the pad electrodes 5*a*1, 5*a*2, 5*b*1, and 5*b*2 is directly connected to the upper end surface of the inner metal pin 6*a* or the outer metal pin 6*b* without a lead line for connecting the pad electrode and the coil electrode 4*a* or 4*b*, the miniaturization of the coil component 1*a* can be achieved. Since the overall lengths of the coil electrodes 4*a* and 4*b* can be shortened, the overall resistances of the coil electrodes 4*a* and 4*b* can be reduced.

Since the pad electrodes 5*a*1, 5*a*2, 5*b*1, and 5*b*2 are disposed to be partially overlapped with the magnetic core 3 in plan view, the pad electrodes 5*a*1, 5*a*2, 5*b*1, and 5*b*2 can be function as a part of a coil. Accordingly, not only the miniaturization of the coil component 1*a* and the improvement in reliability of connection of the coil component 1*a* to the outside but also the improvement in coil characteristics (for example, the improvement in inductance value) can be achieved.

By providing the insulating film 8 on the upper surface of the insulating layer 2, it is possible to adjust the area of the connection surface R of each of the pad electrodes 5*a*1, 5*a*2, 5*b*1, and 5*b*2 to a desired area.

Since a lead line is not provided in this embodiment, each of the pad electrodes 5*a*1, 5*a*2, 5*b*1, and 5*b*2 and the upper wiring pattern 7*a* are close to each other. However, the insulating film 8 covers the upper wiring patterns 7*a* and the pad electrodes 5*a*1, 5*a*2, 5*b*1, and 5*b*2 formed on the upper surface of the insulating layer 2 except for the connection surfaces R set for the pad electrodes 5*a*1, 5*a*2, 5*b*1, and 5*b*2. Therefore, in a case where the coil component 1*a* is connected to the outside by soldering, it is possible to prevent each of the pad electrodes 5*a*1, 5*a*2, 5*b*1, and 5*b*2 and adjacent one of the upper wiring patterns 7*a* from being short-circuited.

Since the pad electrodes 5a1, 5a2, 5b1, and 5b2 are placed at the respective corners of the upper surface of the insulating layer, the areas of the pad electrodes 5 can be easily increased.

In this embodiment, the metal pins 6a and 6b are used as conductors for connecting the upper wiring pattern 7a and the lower wiring pattern 7b. In the case of via conductors and through hole conductors for which the formation of a through hole is needed, a predetermined gap is needed between adjacent conductors for the formation of independent through holes. There is therefore a limit to the narrowing of the gap between the adjacent conductors for the purpose of the increase in the number of windings of a coil. However, in the case of the metal pins 6a and 6b for which the formation of a through hole is not needed, the gap between adjacent metal pins can be easily narrowed. It is therefore possible to increase the number of windings of the coil electrodes 4a and 4b to improve the coil characteristics of the coil electrodes 4a and 4b (to increase the inductances of the coil electrodes 4a and 4b).

Since the specific resistance of the metal pins 6a and 6b is lower than that of a via conductor or a through hole conductor formed by filling conductive paste into a via hole, the overall resistance value of the coil electrodes 4a and 4b can be reduced. The coil component 1a having excellent coil characteristics represented by, for example, a Q value can be provided.

(Modification of Insulating Film)

Figure 2:
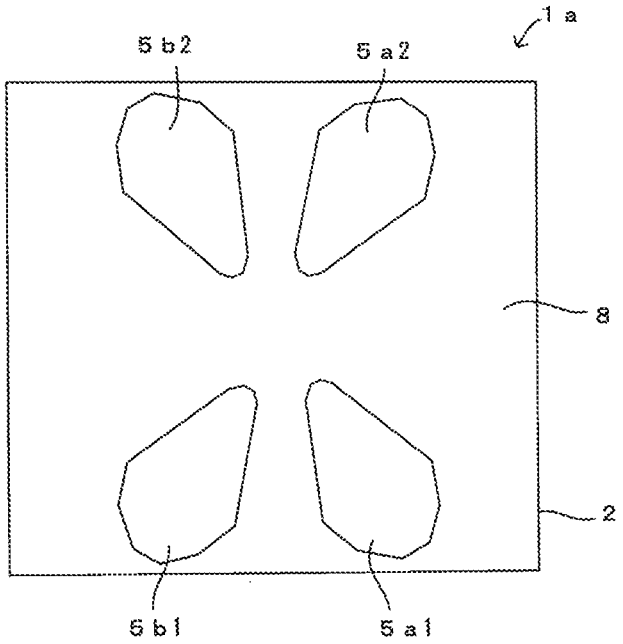
FIG. 2 is a diagram illustrating a modification of an insulating film illustrated in FIG. 1C.

Next, a modification of the insulating film 8 will be described with reference to FIG. 2. FIG. 2 is a diagram illustrating a modification of the insulating film 8 and corresponds to the FIG. 1C.

In the above-described embodiment, the insulating film 8 covers a region other than the connection surfaces R of the pad electrodes 5a1, 5a2, 5b1, and 5b2. However, for example, the insulating film 8 may be laminated on the upper surface of the insulating layer 2 so that the substantially entire regions of the pad electrodes 5a1, 5a2, 5b1, and 5b2 are exposed as illustrated in FIG. 2. In this case, the areas of the connection surfaces R to be connected to the outside can be increased.

(Modification of Pad Electrode)

Figure 3:
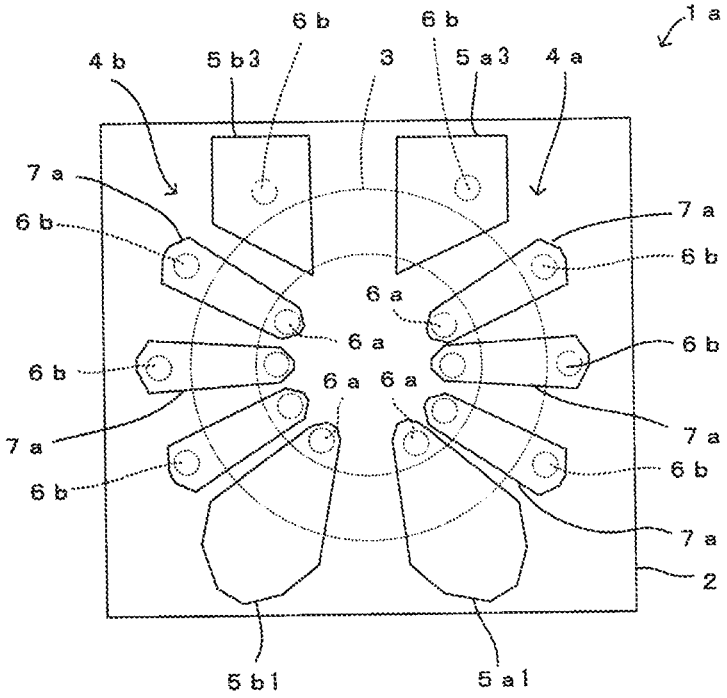
FIG. 3 is a diagram illustrating a modification of a pad electrode illustrated in FIG. 1B.

Next, modifications of the pad electrodes 5a1, 5a2, 5b1, and 5b2 will be described with reference to FIG. 3. FIG. 3 is a diagram illustrating modifications of the pad electrodes 5a1, 5a2, 5b1, and 5b2, and corresponds to FIG. 1B. In FIG. 3, the illustration of the lower wiring patterns 7b is omitted.

In the above-described embodiment, all of the pad electrodes 5a1, 5a2, 5b1, and 5b2 have the same shape when viewed in a plan view. However, as illustrated in FIG. 3, the planar shape of a pad electrode 5a3 may differ from that of the pad electrode 5a1 in the coil electrode 4a, and the planar shape of a pad electrode 5b3 may differ from that of the pad electrode 5b1 in the coil electrode 4b. In this case, the inductance values of the coil electrodes 4a and 4b can be adjusted by changing the area of the pad electrodes 5a1, 5a3, 5b1, and 5b3 overlapping with the magnetic core 3 in plan view.

Second Embodiment

Figure 4A:
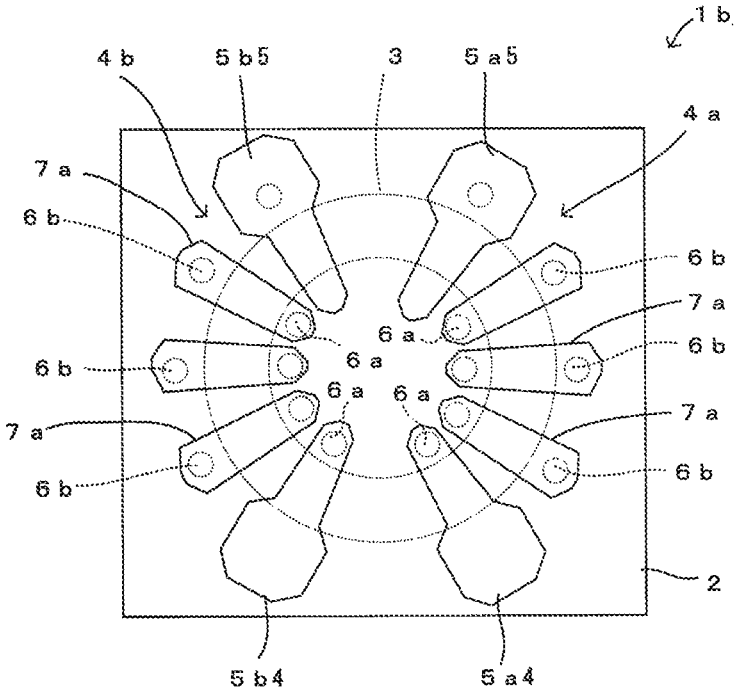
FIGS. 4A and 4B are diagrams illustrating a coil component according to a second embodiment of the present disclosure.
Figure 4B:
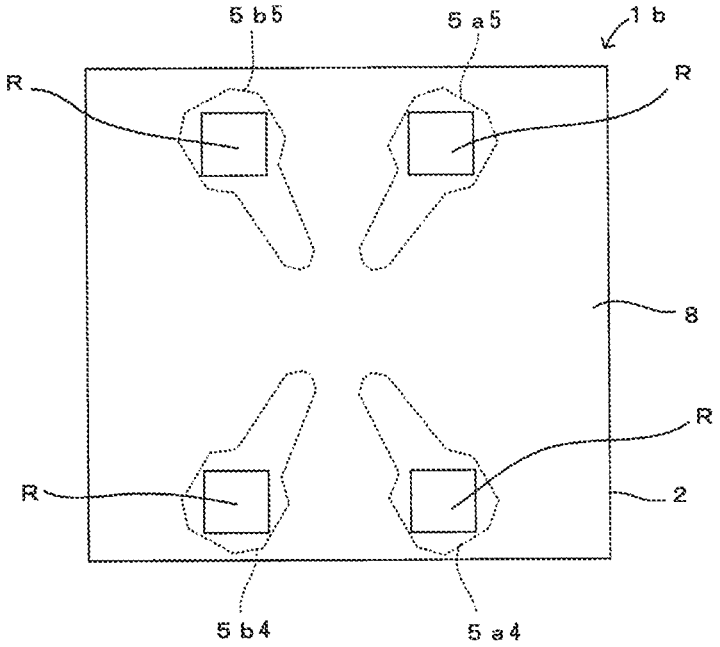

A coil component 1b according to the second embodiment of the present disclosure will be described with reference to FIGS. 4A and 4B. FIG. 4A is a plan view of the coil component 1b in which the insulating film 8 is not illustrated. FIG. 4B is a plan view of the coil component 1b in which the insulating film 8 is illustrated. In FIG. 4A, the illustration of the lower wiring pattern 7b is omitted.

The coil component 1b according to this embodiment differs from the coil component 1a according to the first embodiment described with reference to FIGS. 1A, 1B and 1C in the planar shapes of the pad electrodes 5a4, 5a5, 5b4, and 5b5 as illustrated in FIGS. 4A and 4B. The other configuration of the coil component 1b is the same as that of the coil component 1a according to the first embodiment, and the descriptions thereof will be therefore omitted by assigning the same reference numerals to the corresponding components.

Unlike the planar shapes of the pad electrodes 5a1, 5a2, 5b1, and 5b2 according to the first embodiment, the pad electrodes 5a4, 5a5, 5b4, and 5b5 taper from the outer peripheral side towards the inner peripheral side of the magnetic core 3. As illustrated in FIG. 4B, the connection surfaces R set for the pad electrodes 5a4, 5a5, 5b4, and 5b5 are provided on the outer peripheral side and the insulating film 8 covers the upper surface of the insulating layer 2 except for the connection surfaces R.

In a case where the magnetic core 3 is ring-shaped, the inner peripheral side is has a smaller design space than the outer peripheral side. The numbers of windings of the coil electrodes 4a and 4b can therefore be easily increased by reducing the line widths of the pad electrodes 5a4, 5a5, 5b4, and 5b5 on the inner peripheral side. By setting the connection surfaces R for the pad electrodes 5a4, 5a5, 5b4, and 5b5 on the outer peripheral side, the areas of the connection surfaces R to be connected to the outside can be easily increased.

Third Embodiment

Figure 5A:
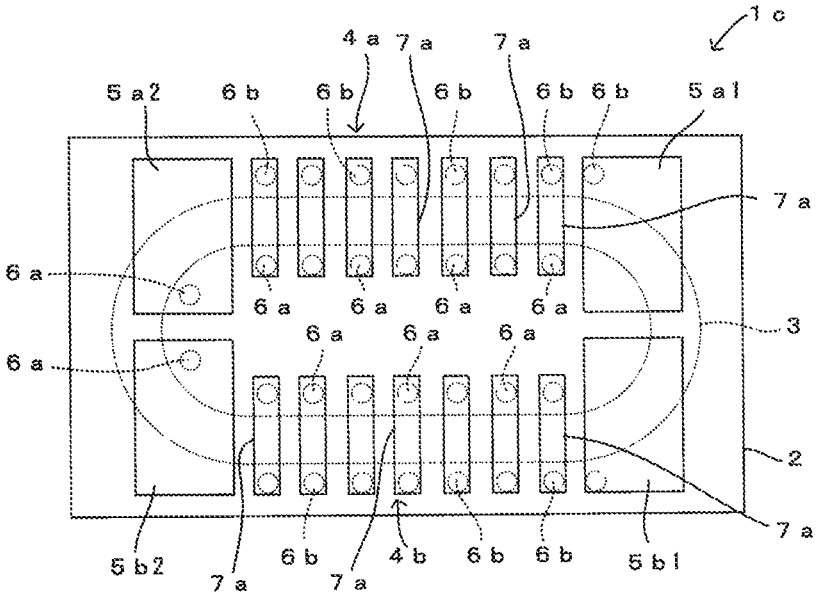
FIGS. 5A and 5B are diagrams illustrating a coil component according to a third embodiment of the present disclosure.
Figure 5B:
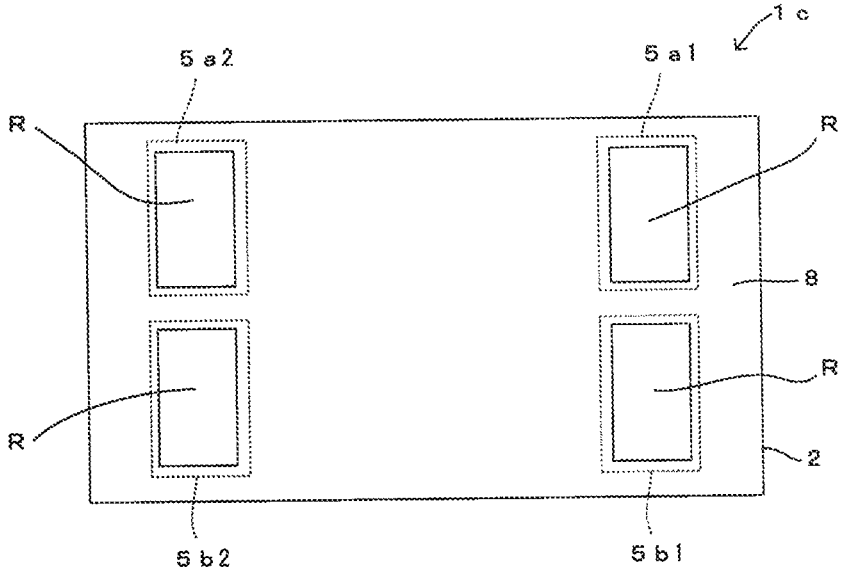

A coil component 1c according to the third embodiment of the present disclosure will be described with reference to FIGS. 5A and 5B. FIG. 5A is a plan view of the coil component 1c in which the insulating film 8 is not illustrated. FIG. 5B is a plan view of the coil component 1c in which the insulating film 8 is illustrated. In FIG. 5A, the illustration of the lower wiring pattern 7b is omitted.

As illustrated in FIGS. 5A and 5B, the coil component 1c according to this embodiment differs from the coil component 1a according to the first embodiment described with reference to FIGS. 1A, 1B and 1C in that the planar shape of the magnetic core 3 is a track shape, the planar shapes of the upper wiring patterns 7a are reed shapes, and the pad electrodes 5a1, 5a2, 5b1, and 5b2 are rectangular in shape when viewed in a plan view. The other configuration of the coil component 1c is the same as that of the coil component 1a according to the first embodiment, and the descriptions thereof will be therefore omitted by assigning the same reference numerals to the corresponding components.

The upper wiring patterns 7a of the coil electrodes 4a and 4b are provided in a straight portion of the magnetic core 3 that is track-shaped in plan view. The pad electrodes 5a1, 5a2, 5b1, and 5b2 are provided in a curve portion of the magnetic core 3. In this embodiment, the upper wiring patterns 7a of the coil electrodes 4a and 4b are substantially parallel to one another and are spaced at regular intervals. As illustrated in FIG. 5B, the insulating film 8 is laminated on the upper surface of the insulating layer 2 in a state of covering the outer edge portions of the pad electrodes 5a1, 5a2, 5b1, and 5b2.

With this configuration, the numbers of the windings of the coil electrodes 4a and 4b can be easily increased by providing the upper wiring patterns 7a in the straight portion of the magnetic core 3 where the inner and outer sides have the same design space. Furthermore, the areas of the pad electrodes 5*a*1, 5*a*2, 5*b*1, and 5*b*2 can be easily increased by disposing the pad electrodes 5*a*1, 5*a*2, 5*b*1, and 5*b*2 at the respective four corners of the rectangular upper surface of the insulating layer 2.

Fourth Embodiment

Figure 6A:
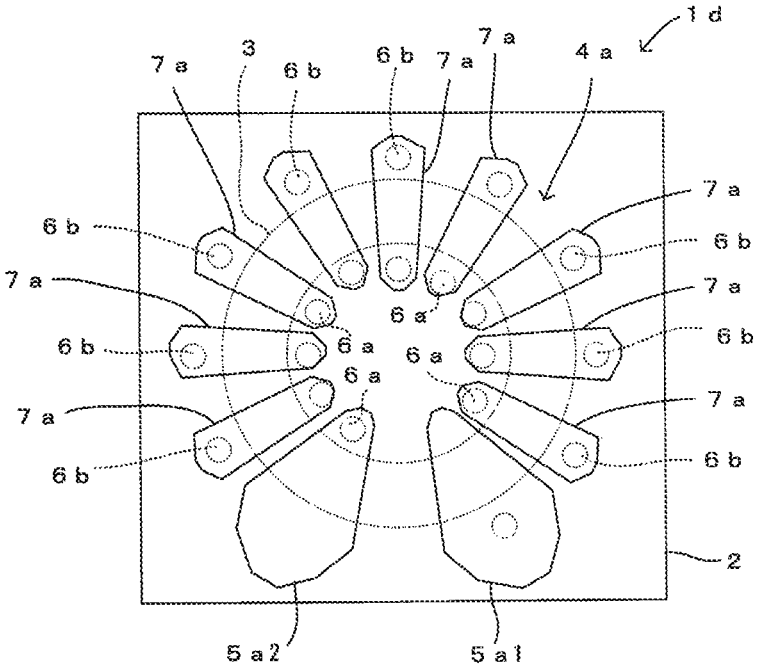
FIGS. 6A and 6B are diagrams illustrating a coil component according to a fourth embodiment of the present disclosure.
Figure 6B:
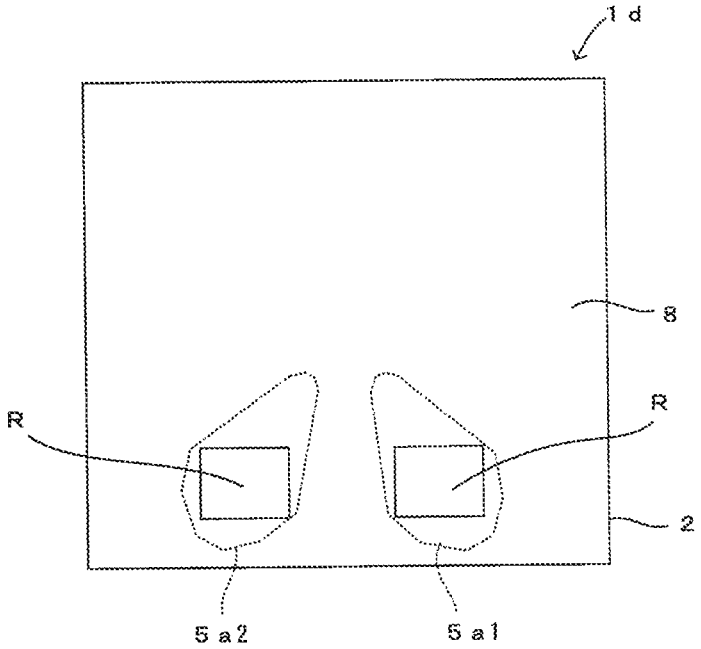

A coil component 1*d* according to the fourth embodiment of the present disclosure will be described with reference to FIGS. 6A and 6B. FIG. 6A is a plan view of the coil component 1*d* in which the insulating film 8 is not illustrated. FIG. 6B is a plan view of the coil component 1*d* in which the insulating film 8 is illustrated. In FIG. 6A, the illustration of the lower wiring pattern 7*b* is omitted.

As illustrated in FIGS. 6A and 6B, the coil component 1*d* according to this embodiment differs from the coil component 1*a* according to the first embodiment described with reference to FIGS. 1A, 1B and 1C in that the single coil electrode 4*a* is wound around the magnetic core 3. The other configuration of the coil component 1*d* is the same as that of the coil component 1*a* according to the first embodiment, and the descriptions thereof will be therefore omitted by assigning the same reference numerals to the corresponding components.

The single coil electrode 4*a* is wound substantially all around the magnetic core 3 to form a toroidal coil. With this configuration in which the single coil electrode 4*a* is wound around the magnetic core 3, an effect similar to that obtained with the coil component 1*a* according to the first embodiment can be obtained.

Figure 7:
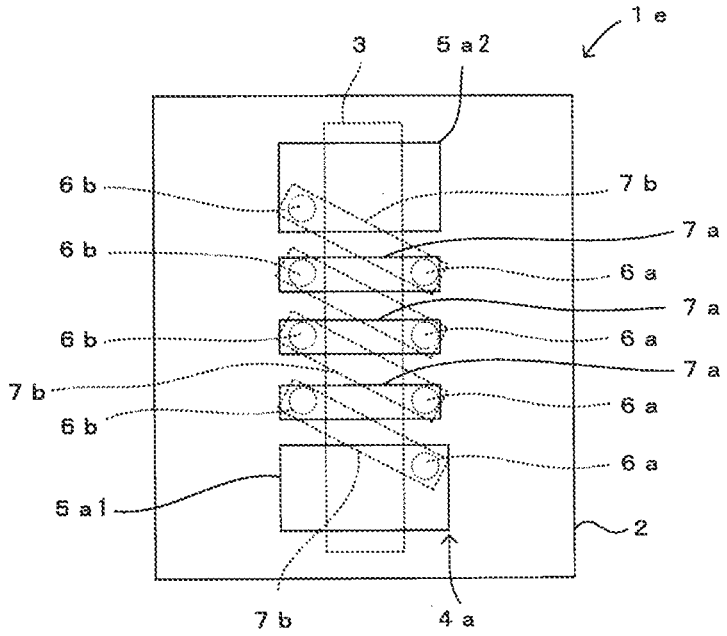
FIG. 7 is a modification of a magnetic core.
Figure 8:
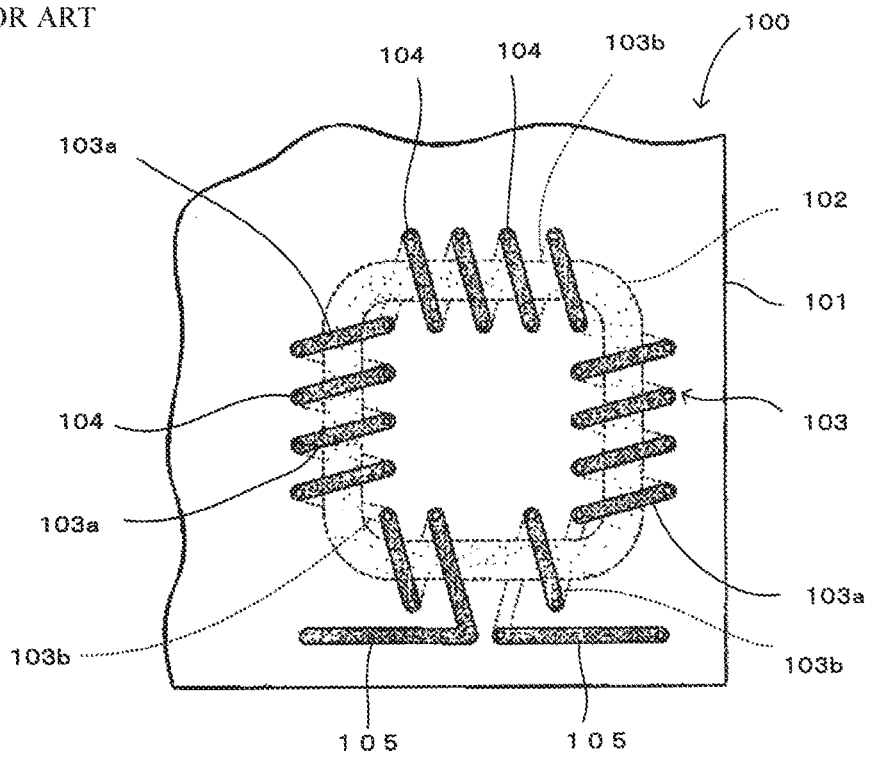
FIG. 8 PRIOR ART
FIG. 8 is a partial plan view of a coil component in the related art.

The present disclosure is not limited to the above-described embodiments, and various changes can be made to the above-described embodiments without departing from the scope and sprit of the present disclosure. For example, although a case where the magnetic core 3 has a toroidal shape has been described in the above embodiments, the magnetic core 3 may has, for example, a bar shape as illustrated in FIG. 7. FIG. 7 is a diagram illustrating a modification of the magnetic core 3, and corresponds to FIG. 1B.

A conductor for connecting the upper wiring pattern 7*a* and the lower wiring pattern 7*b* is not limited to the metal pins 6*a* and 6*b*, and may be, for example, a via conductor or a through hole conductor.

Although a case where the insulating film 8 covers the substantially entire upper surface of the insulating layer 2 except for the connection surfaces R set for the respective pad electrodes 5*a*1, 5*a*2, 5*a*3, 5*a*4, 5*a*5, 5*b*1, 5*b*2, 5*b*3, 5*b*4, and 5*b*5 has been described in the above-described embodiments, a dam member may be placed around each of the upper wiring patterns 7*a*, the lower wiring patterns 7*b*, and the pad electrode 5*a*1, 5*a*2, 5*a*3, 5*a*4, 5*a*5, 5*b*1, 5*b*2, 5*b*3, 5*b*4, and 5*b*5 along with or instead of the insulating film 8. By encircling each of the upper wiring patterns 7*a*, the lower wiring patterns 7*b*, and the pad electrode 5*a*1, 5*a*2, 5*a*3, 5*a*4, 5*a*5, 5*b*1, 5*b*2, 5*b*3, 5*b*4, and 5*b*5, a short circuit between these components can be prevented. This dam member may be formed of, for example, a resist resin.

The present disclosure is widely applicable to various coil components each including an insulating layer in which a coil core is embedded and a coil electrode wound around the coil core.

1*a* to 1*e* coil component
2 insulating layer
3 magnetic core (coil core)
4*a* and 4*b* coil electrode
5*a*1, 5*a*2, 5*a*3, 5*a*4, 5*a*5, 5*b*1, 5*b*2, 5*b*3, 5*b*4, and 5*b*5 pad electrode
6*a* metal pin (inner metal pin, one-side columnar conductor)
6*b* metal pin (outer metal pin, other-side columnar conductor)
7*a* upper wiring pattern (first wiring pattern)
7*b* lower wiring pattern (second wiring pattern)
8 insulating film
R connection surface

The invention claimed is:

1. A coil component comprising:
an insulating layer having a coil core;
a coil electrode wound around the coil core; and
an external connection pad electrode provided on one main surface of the insulating layer and connected to the coil electrode,
wherein the coil electrode includes,
a plurality of one-side columnar conductors arranged on one side of the coil core in a state of standing in a thickness direction of the insulating layer,
a plurality of other-side columnar conductors arranged on another side of the coil core in a state of standing in the thickness direction of the insulating layer to be paired with the corresponding one-side columnar conductors,
a plurality of first wiring patterns provided on the one main surface of the insulating layer, wherein each of the plurality of first wiring patterns is configured to connect one end surfaces of each of the one-side columnar conductors and each of the other-side columnar conductors paired with each other, and
a plurality of second wiring patterns provided on another main surface of the insulating layer, wherein each of the plurality of second wiring patterns is configured to connect another end surface of each of the one-side columnar conductors and another end surface of each of the other-side columnar conductors adjacent to each of the other-side columnar conductors paired with each of the one-side columnar conductors on a predetermined side, and
wherein the pad electrode is directly connected to the one end surface of a predetermined one of the one-side columnar conductors or the one end surface of a predetermined one of the other-side columnar conductors and has, in a plan view, an area larger than an area of the single wiring pattern.

2. The coil component according to claim 1, wherein the pad electrode is partially overlapped with the coil core in a plan view.

3. The coil component according to claim 1,
wherein an insulating film is overlapped with a part of the pad electrode on the one main surface of the insulating layer, and
wherein a remaining part of the pad electrode excluding the part of the pad electrode functions as an external connection surface.

4. The coil component according to claim 3, wherein the connection surface is overlapped with the coil core in a plan view.

5. The coil component according to claim 1,
wherein the one main surface of the insulating layer is rectangular in shape when viewed in a plan view, and
wherein the pad electrode is provided in one corner portion of the one main surface of the insulating layer.

6. The coil component according to claim 1, wherein each of the one-side columnar conductors and the other-side columnar conductors comprises a metal pin.

7. The coil component according to claim 2, wherein an insulating film is overlapped with a part of the pad electrode on the one main surface of the insulating layer, and wherein a remaining part of the pad electrode excluding the part of the pad electrode functions as an external connection surface.

8. The coil component according to claim 2, wherein the one main surface of the insulating layer is rectangular in shape when viewed in a plan view, and wherein the pad electrode is provided in one corner portion of the one main surface of the insulating layer.

9. The coil component according to claim 3, wherein the one main surface of the insulating layer is rectangular in shape when viewed in a plan view, and wherein the pad electrode is provided in one corner portion of the one main surface of the insulating layer.

10. The coil component according to claim 4, wherein the one main surface of the insulating layer is rectangular in shape when viewed in a plan view, and wherein the pad electrode is provided in one corner portion of the one main surface of the insulating layer.

11. The coil component according to claim 2, wherein each of the one-side columnar conductors and the other-side columnar conductors comprises a metal pin.

12. The coil component according to claim 3, wherein each of the one-side columnar conductors and the other-side columnar conductors comprises a metal pin.

13. The coil component according to claim 4, wherein each of the one-side columnar conductors and the other-side columnar conductors comprises a metal pin.

14. The coil component according to claim 5, wherein each of the one-side columnar conductors and the other-side columnar conductors comprises a metal pin.

* * * * *